US006719384B1

(12) United States Patent
Parise et al.

(10) Patent No.: US 6,719,384 B1
(45) Date of Patent: Apr. 13, 2004

(54) SUSPENDABLE LOCKER

(75) Inventors: Jack A. Parise, Kenosha, WI (US); John J. Landree, Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 117 days.

(21) Appl. No.: 09/750,976

(22) Filed: Jan. 2, 2001

(51) Int. Cl.[7] ..... A47B 97/00
(52) U.S. Cl. ..... 312/249.9; 312/317.2
(58) Field of Search ..... 312/249.1, 249.8, 312/249.9, 249.11, 249.12, 249.13, 902, 101, 245, 311, 210, 213, 242, 246, 247, 248

(56) References Cited

U.S. PATENT DOCUMENTS

| | | | | | |
|---|---|---|---|---|---|
| 376,070 | A | | 1/1888 | Cobb et al. | |
| 542,341 | A | | 7/1895 | Little | |
| 1,745,593 | A | | 2/1930 | Adams | |
| 2,140,418 | A | | 12/1938 | Dilts | |
| D154,453 | S | | 7/1949 | Schukat | |
| D159,534 | S | | 8/1950 | Raichert | |
| 3,120,076 | A | * | 2/1964 | Zuch | 312/210 |
| 3,316,048 | A | * | 4/1967 | Levy | 312/290 |
| 3,455,620 | A | | 7/1969 | Coburn | |
| 3,459,463 | A | | 8/1969 | Nacht | |
| 3,656,587 | A | | 4/1972 | Siegel | |
| 3,872,686 | A | * | 3/1975 | Patrie | 62/237 |
| 4,026,616 | A | | 5/1977 | Kuehl | |
| 4,084,125 | A | | 4/1978 | King | |
| 4,134,525 | A | * | 1/1979 | Respoli | 206/1.7 |
| 4,337,988 | A | | 7/1982 | Schenck | |
| 4,418,969 | A | | 12/1983 | Hettman | |
| 4,431,080 | A | | 2/1984 | Everhart | |
| 4,491,375 | A | | 1/1985 | Ugalde | |
| 4,669,790 | A | | 6/1987 | Briggs | |
| 4,763,579 | A | * | 8/1988 | Cibulak | 312/245 X |
| 4,784,446 | A | | 11/1988 | Newhouse | |
| 4,893,885 | A | | 1/1990 | Borello | |
| 4,961,612 | A | * | 10/1990 | Howard | 312/213 X |
| 5,245,801 | A | | 9/1993 | Boesvert | |
| 5,443,311 | A | | 8/1995 | Kadlecek et al. | 312/308 |
| 5,584,548 | A | | 12/1996 | Miller | |
| 5,662,396 | A | | 9/1997 | Reeder et al. | |
| 5,890,325 | A | * | 4/1999 | Corcorran et al. | 52/36.1 |
| 6,053,588 | A | * | 4/2000 | Biggel et al. | 312/249.11 X |
| 6,113,201 | A | * | 9/2000 | Bauer | 312/245 |

FOREIGN PATENT DOCUMENTS

| | | | | |
|---|---|---|---|---|
| CA | 2230736 | * | 3/1999 | |
| DE | 297 05 297 U1 | | 8/1997 | |
| FR | 2 768 596 | | 3/1999 | |
| GB | 477158 | * | 12/1937 | 312/317.2 |
| JP | 5-130920 | * | 5/1993 | 312/249.9 |

* cited by examiner

*Primary Examiner*—James O. Hansen
(74) *Attorney, Agent, or Firm*—Seyfarth Shaw LLP

(57) ABSTRACT

The suspendable locker has a plurality of side walls and a top wall interconnected to define an interior space. The suspendable locker has an open bottom leaving the interior space exposed from below. A door is hingedly connected to a side wall to provide an access opening into the interior space along a side at the bottom so a cart can be rolled into and from the interior space. An attachment structure for suspending the locker from a storage cabinet is connected to a side wall. The attachment structure includes a pair of L-shaped flanges connected to an exterior surface of a side wall. The L-shaped flanges engage a lip on a tool storage cabinet, enabling the suspendable locker to be cantilevered from the storage cabinet.

8 Claims, 3 Drawing Sheets

SUSPENDABLE LOCKER

BACKGROUND

The subject matter of this application relates to storage devices. More particularly, this application relates to a suspendable locker adapted to be coupled to a wall of a storage cabinet.

Large rolling tool cabinets are often used to secure tools which are kept at a job site. These tool cabinets may be placed at a central location in order to be easily accessible to those who use the tools. These tool cabinets are often heavily laden with tools, or other work articles, so it is often impractical to roll them to a particular work site. Consequently, small rolling carts are often employed to transport articles to the work site and back. At the end of the workday, the articles are removed from the rolling cart and placed back into the tool cabinet and secured.

Often it is desirable for mechanics and workmen to leave work pieces, equipment, or tools on a rolling cart undisturbed at the end of a work period, so that they may more easily continue their work where they left off the next period. Also, loading and unloading tools and other articles onto and off of the rolling cart can be quite time consuming, and sometimes objects will not readily fit into a tool cabinet. As a result, equipment and tools are often left on rolling carts unsecured.

Tool cabinets also usually cannot adequately store and secure computers, and are often too dirty an environment to keep paperwork. It is sometimes beneficial to have a computer and paperwork near a tool cabinet. Workmen and mechanics sometimes utilize computers to assist them at their jobs, and they almost always have paperwork to fill out and store. Since tool cabinets are not particularly adapted to store them, computers and paperwork are commonly stored elsewhere, sometimes making them less accessible.

SUMMARY

Generally, this application relates to a suspendable locker adapted to be coupled to a wall of a storage cabinet, which avoids the disadvantages of the prior art while affording additional structural and operational advantages.

An important feature is the provision of a locker which is capable of being suspended from a side wall of a storage cabinet.

Another important feature is the provision of a locker which can secure a rolling cart.

Another important feature is the provision of a suspendable locker capable of storing a computer and/or paperwork.

In connection with the foregoing features, yet another feature is the provision of a method for the storage of tools and other articles.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
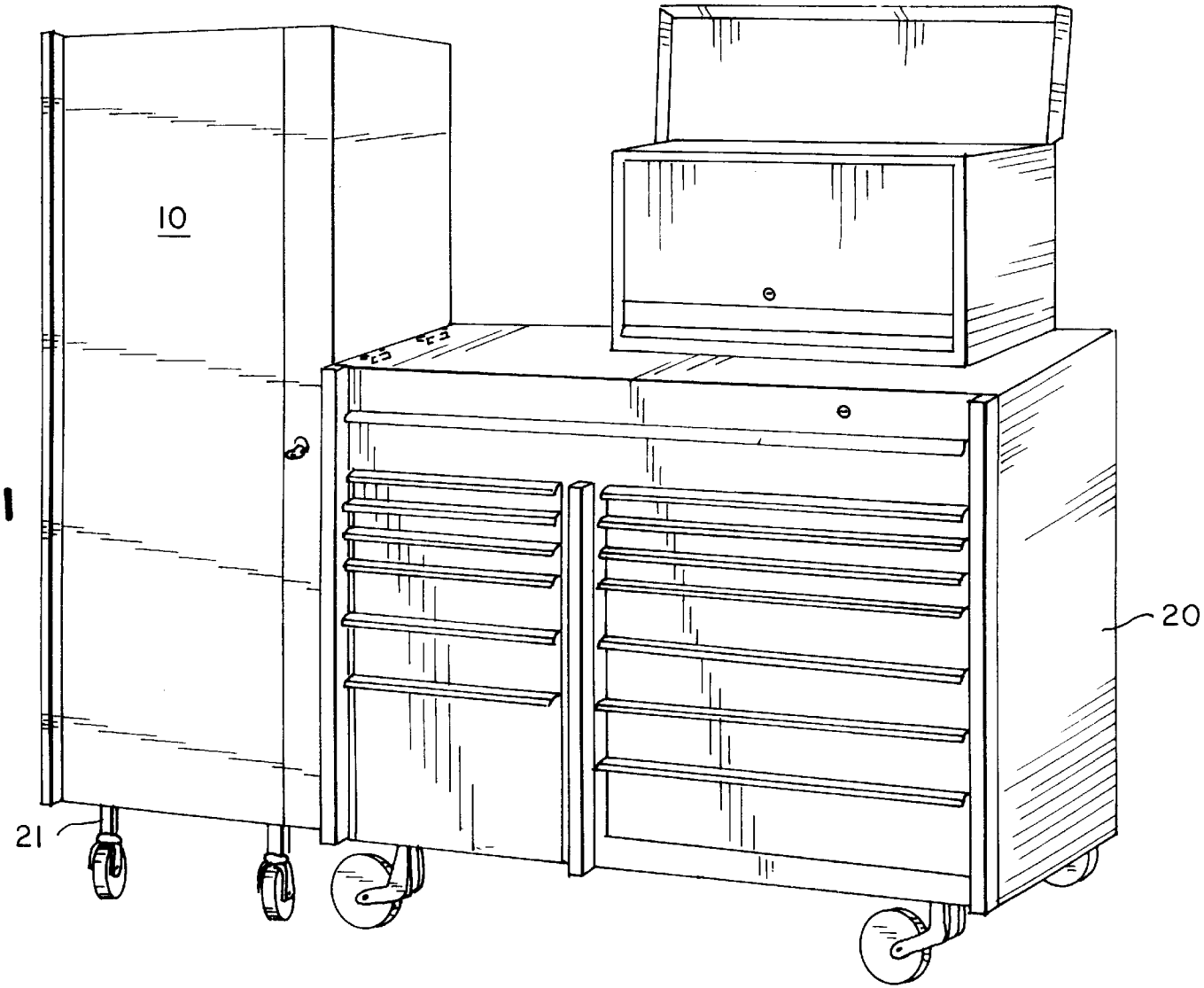
FIG. 1 is a perspective view of a suspendable locker attached to a tool cabinet.

Referring to FIG. 1, an embodiment of the suspendable locker, referred to generally by the numeral 10, is shown suspended from a tool cabinet 20 with a rolling cart 21 stored in the locker. The suspendable locker 10 is cantilevered above a floor, enabling it to be rolled around with the tool cabinet 20.

Figure 2:
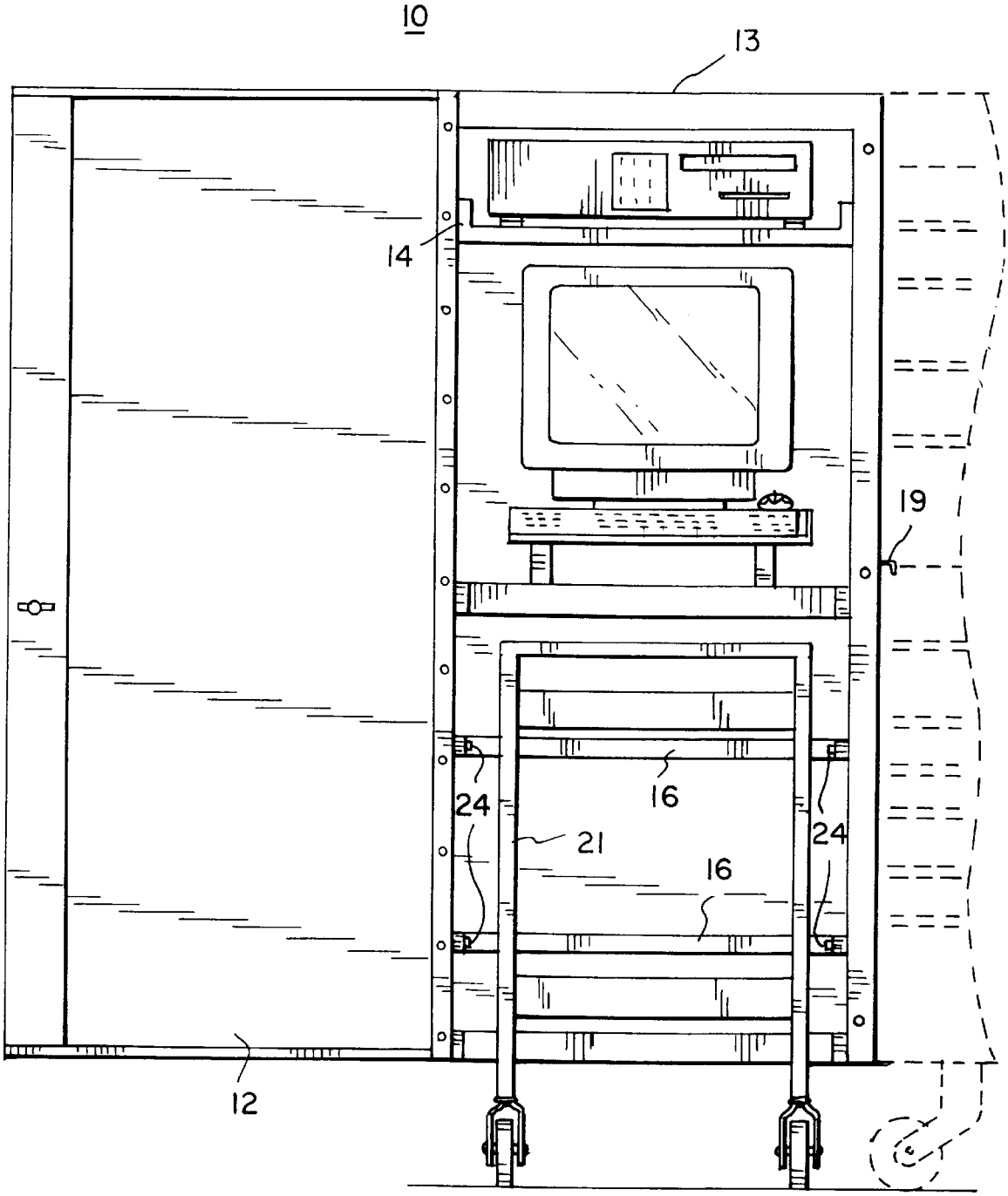
FIG. 2 is a fragmentary front elevational view of the embodiment in FIG. 1 with the locker door open to reveal underlying structure therein.
Figure 3:
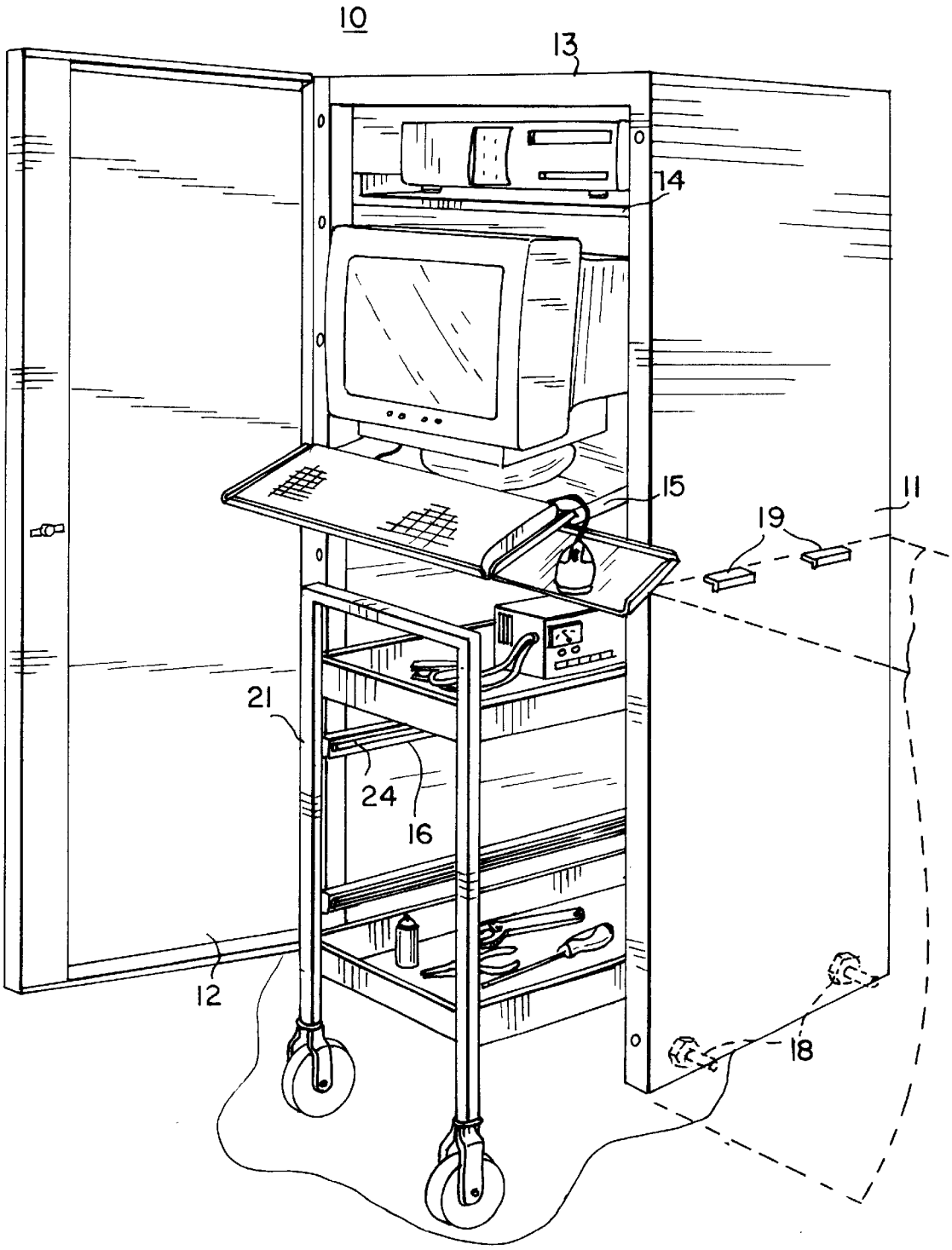
FIG. 3 is an enlarged perspective view of the embodiment in FIG. 2 with the retractable shelf retracted and cart partially withdrawn from the locker.

Referring to FIGS. 2 and 3, the suspendable locker 10 has a plurality of side walls 11 and a top wall 13 interconnected to define an open-bottom interior space. A door 12 is hingedly connected to a side wall to provide an access opening into the interior space along a side. An attachment structure for suspending the locker from a storage cabinet is connected to a side wall 11.

The suspendable locker 10 has an open bottom leaving the interior space exposed from below. The absence of a bottom enables the suspendable locker 10 to secure therein the rolling cart 21 or other objects which rest on the floor and are not removable through the open bottom.

In an embodiment of the suspendable locker 10, the attachment structure includes a pair of L-shaped flanges 19. Each L-shaped flange 19 is connected to an exterior surface of a side wall 11 and engages a lip on the tool storage cabinet 20, enabling the suspendable locker 10 to be cantilevered from the storage cabinet 20. The L-shaped flanges 19 are one means for suspending the suspendable locker 10 from a tool storage cabinet 20, and are not meant to be construed as a limitation thereof. There are other means available which can be utilized instead of the L-shaped flange 19 to suspend the suspendable locker 10 from the tool cabinet 20. Referring to FIG. 2, the attachment structure can also include fasteners 18 extending through corresponding apertures in the side wall 11 and the tool storage cabinet 20.

Referring to FIGS. 2 and 3, at least one shelf 14 is suspended within the interior space, connected to the side walls 11. The shelves can be vertically or horizontally aligned depending on the application. In one embodiment, a shelf 15 is retractable, enabling the shelf to extend outwardly from within the interior space. It is contemplated that a computer and keyboard is placed on the retractable shelf 15, enabling such device to be accessible to a user when the shelf is fully extended, but still securable within the suspendable locker 10 when the shelf is retracted.

Reinforcing channels 16, extend across interior lower surfaces of the side walls 11, providing additional structural support to the side walls. A plurality of bumper guards 24 can be mounted on the reinforcing channels to protect the side walls from damage.

It is contemplated that the suspendable locker 10 is coupled to a rolling tool cabinet 20, and is transported with the rolling tool cabinet 20. The suspendable locker 10 would provide a place in which to store paperwork, a computer, and a rolling cart 21. One of the major benefits of the suspendable locker 10 is that the rolling cart 21 can be easily secured with tools, equipment, and other articles stored thereon. The rolling cart 21 is secured simply by rolling it through the doorway of the suspendable locker 10 into the interior space, and locking the door behind it. Prior to the suspendable locker 10, tools or equipment were either left unsecured on the rolling cart 21 with the tools and articles thereon, or else they were removed from the rolling cart 21 and stored overnight in the tool cabinet 20 and placed back onto the rolling cart the next day.

The matter set forth in the foregoing description and accompanying drawings is offered by way of illustration only and not as a limitation. While an embodiment has been shown and described, it will be obvious to those skilled in the art that changes and modifications may be made without deporting from the broader aspects of applicants' contribution. The actual scope of the protection sought in intended to be defined in the following claims when viewed in their proper perspective based on the prior art.

What is claimed is:

1. A suspendable locker adapted to be coupled to a storage cabinet, the locker comprising a plurality of side walls, at least one side wall having an aperture extending therethrough, each side wall having plural spaced-apart discrete reinforcing structural supports, and a top wall interconnected with the side walls to define an open-bottom interior space, plural bumper guards respectively disposed on the structural supports, a door hingedly connected to a side wall to provide an access opening into the interior space along a side at the open bottom, and an attachment structure including at least one L-shaped flange located along an exterior surface of a side wall for suspending the locker from the storage cabinet and a fastener extending through the aperture for attachment to the storage cabinet.

2. The suspendable locker of claim 1, and further comprising at least one shelf disposed within the interior space.

3. The suspendable locker of claim 1, and further comprising a retractable shelf extendable from within the interior space.

4. A storage system comprising a cabinet section and a locker section suspended from the cabinet section, the locker section including a plurality of side walls, each side wall having plural spaced-apart discrete reinforcing structural supports, corresponding apertures respectively formed through a side wall of the locker section and an adjacent portion of the cabinet section, and a top wall interconnected with the side walls to define an open-bottom interior space, plural bumper guards respectively disposed on the structural supports, a door hingedly connected to a side wall to provide and access opening into the interior space along a side at the open bottom, and an attachment structure including at least one L-shaped flange located along an exterior surface of a side wall for suspending the locker section from the cabinet section and a fastener extending through the apertures to secure the locker section to the cabinet section.

5. The storage system of claim 4, and further comprising wheels extending from a bottom portion of the cabinet section.

6. The storage system of claim 4, and further comprising at least one shelf disposed within the interior space.

7. The storage system of claim 4, and further comprising a retractable shelf extendable from within the interior space.

8. The storage system of claim 4, and further comprising a rolling cart disposable within the interior space and rollable into and from the interior space through the opening when the door is open.

* * * * *